United States Patent [19]

Ohta et al.

[11] 4,282,563

[45] Aug. 4, 1981

[54] FLUORESCENT LAMP UNIT

[75] Inventors: Shigenori Ohta; Katsuyuki Hosoya, both of Ohme, Japan

[73] Assignee: Hitachi, Ltd., Tokyo, Japan

[21] Appl. No.: 49,169

[22] Filed: Jun. 18, 1979

[30] Foreign Application Priority Data

Jun. 16, 1978 [JP] Japan ..... 53/72159

[51] Int. Cl.[3] ..... F21S 3/00

[52] U.S. Cl. ..... 362/216; 362/226; 362/377; 362/378

[58] Field of Search ..... 362/216, 226, 377, 378

[56] References Cited

U.S. PATENT DOCUMENTS

| | | | |
|---|---|---|---|
| 3,953,761 | 4/1976 | Giudice | 362/216 |
| 4,093,974 | 6/1978 | Wheeler | 362/216 |
| 4,161,020 | 7/1979 | Miller | 362/216 |

*Primary Examiner*—Stephen J. Lechert, Jr.

*Attorney, Agent, or Firm*—Craig and Antonelli

[57] ABSTRACT

A fluorescent lamp unit according to this invention has a structure wherein a circular fluorescent tube is fixed merely by the engagement between an upper cover having a screw base and a lower cover. A starting circuit of the fluorescent lamp unit uses a ballast resistor as a stabilizer.

Accordingly, the fluorescent lamp unit is small in size, light in weight and low in price and can be conveniently attached to a socket.

15 Claims, 7 Drawing Figures

FLUORESCENT LAMP UNIT

BACKGROUND OF THE INVENTION

1. Field of the Invention

This invention relates to an economical fluorescent lamp unit which can be easily attached to a socket.

2. Description of the Prior Art

In these days of energy crises, the waves of energy conservation have surged upon the general household lighting fixtures. That is, the trend of the conversion from incandescent lamps of low efficiency to fluorescent lamps of high efficiency has become active. Fluorescent lamps each including a screw base which can be directly attached to a socket for the conventional incandescent lamp and which permits the convenient use of the fluorescent lamp have been known for a considerably long time. For example, U.S. Pat. No. 3,191,087 discloses a fluorescent lamp with a screw base wherein a circular fluorescent tube is arranged around a box which receives therein starting circuit components such as a ballast. Further, U.S. Pat. No. 3,953,761 discloses a fluorescent lamp with a screw base wherein a transformed fluorescent tube is arranged around a box which receives therein starting circuit components such as a ballast.

However, prior-art fluorescent lamps with screw bases including the aforecited examples use inductive stabilizers as ballasts. These fluorescent lamps therefore have such disadvantages that the geometry is comparatively large, that the total weight is heavy and that the price is high. They also have the disadvantages that the number of stages of assemblage in the production is large and that the cost of production is high.

SUMMARY OF THE INVENTION

It is accordingly an object of this invention to provide a fluorescent lamp unit which is free from the disadvantages described above and which is small in size, light in weight and low in cost and can be conveniently used.

In order to accomplish this object, the present invention consists in that a circular fluorescent tube is fixed merely by the connection or engagement between an upper cover having a screw base and a lower cover and that a ballast resistor is comprised as a stabilizer.

Accordingly to such characterizing construction of this invention, the ballast resistor is used as the stabilizer instead of the conventional inductive ballast, and it is therefore possible to render the size small, the weight light and the price low. Owing to the structure wherein the circular fluorescent tube is held merely by the connection between the upper cover and the lower cover, the period of time for assemblage during production is greatly shortened. The production cost can therefore be made much lower. The fluorescent lamp unit with the screw base according to this invention as has such features can be directly attached to a socket for the ordinary incandescent lamp and can be conveniently used.

These and further objects, features and advantages of the present invention will become more obvious from the following description when taken in connection with the accompanying drawings.

DESCRIPTION OF THE PREFERRED EMBODIMENTS

Figure 1:
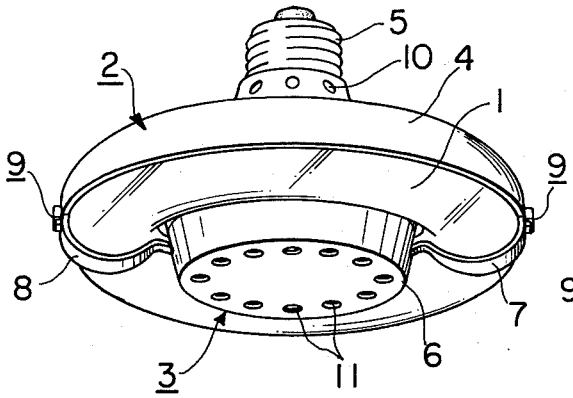
FIG. 1 is a perspective view of a fluorescent lamp unit with a screw base which employs a circular fluorescent tube constructed according to this invention.

FIG. 1 shows the whole construction of a fluorescent lamp unit according to this invention. Referring to this figure, a smallsized circular fluorescent tube 1 having no base (for example, a tube FC6T9) is held by a semi-transparent upper cover 2 which has been formed by molding a resin (for example, polypropylene) and a semi-transparent lower cover 3 which has also been formed by molding the same resin.

The upper cover 2 has an edge cover member 4 which covers substantially the upper half portion of the circular fluorescent tube 1, and a screw base 5.

The lower cover 3 consists of a protective cover member 6 for covering the central part of the upper cover 2, and holder members 7 and 8 for holding parts of substantially the lower half portion of the circular fluorescent tube 1. Simultaneously with holding the circular fluorescent tube 1, the holder member 8 serves to cover a connection portion at the ends of the circular fluorescent tube 1. Accordingly, the area of the holder member 8 for holding the circular fluorescent tube 1 is larger than that of the holder member 7.

The edge cover member 4 of the upper cover 2 and the holder members 7 and 8 of the lower cover 3 have connection or engagement members 9 which engage each other in order to hold the circular fluorescent tube 1 more stably.

Figure 2A:
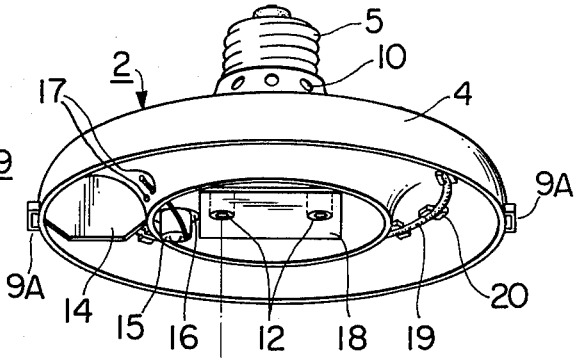
FIGS. 2A and 2B are perspective views respectively showing an upper cover and a lower cover of the fluorescent lamp unit illustrated in FIG. 1.

The upper cover 2 and the lower cover 3 are respectively provided with holes 10 and 11 which serve to effectively radiate heat generated from a ballast resistor 18 (as shown in FIG. 2A).

Figure 2B:
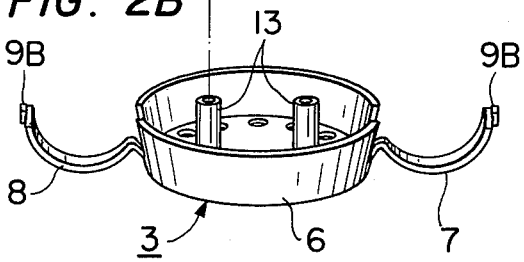

FIG. 2A shows the upper cover 2 illustrated in FIG. 1, while FIG. 2B shows the lower cover 3 illustrated in FIG. 1. Referring to these figures, the upper cover 2 and the lower cover 3 are fixed by bringing into engagement two spacing columns 12 disposed in the central part of the upper cover 2 and two spacing columns 13 disposed in the protective cover member 6 of the lower cover 3. In the present embodiment, they are fixed by well-known bolts and nuts with the hollow spacing columns 12 and 13.

The engagement members 9 between the edge cover member 4 of the upper cover 2 and the holder members 7 and 8 of the lower cover 3 have a structure wherein male members 9B disposed on the holder members 7 and 8 are snugly inserted in female members 9A disposed in the edge cover member 4.

An insulating separator 14 is disposed in a part which is surrounded by the edge cover member 4 of the upper cover 2 and the holder member 8 of the lower cover 3. The separator 14 has the function of preventing the contact of lead wires at the ends of the circular fluorescent tube 1 with no base in such a way that the tube ends are confronted with the separator 14 interposed therebetween.

The electrical connections between the lead wires of the circular fluorescent tube 1 and a glow switch 15 as well as a noise suppressing capacitor 16 are executed through holes 17 which are provided in the edge cover member 4.

Figure 3:
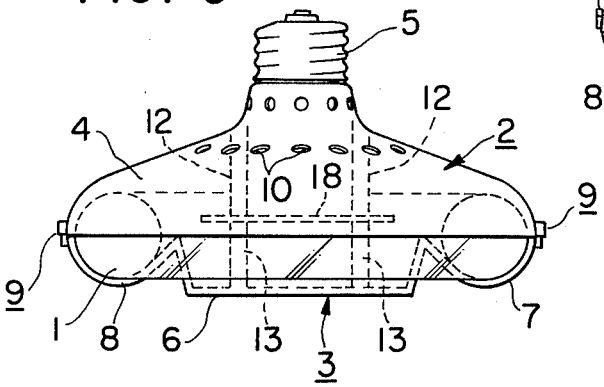
FIG. 3 is a front view of the fluorescent lamp unit illustrated in FIG. 1.

The ballast resistor 18 is fixed in the state under which it is held between the engaging members of the spacing columns 12 and 13 for bringing the upper cover 2 and the lower cover 3 into engagement. That is, the upper cover 2 and the lower cover 3 are used for fixing the circular fluorescent tube 1 and also for fixing the ballast resistor 18. These positional relations will become clearer with reference to FIG. 3. The degradation of the starting ability which is attributed to the use of the ballast resistor 18 as the stabilizer is compensated for by employing a starter conductor 19. The starter conductor 19 is disposed on the inner surface of the edge cover member 4 of the upper cover 2. As the starter conductor 19, a coated lead is held by fixing members 20 which are provided on the inner surface of the edge cover member 4.

Figure 4:
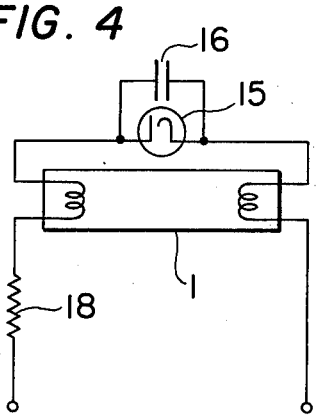
FIG. 4 is a circuit diagram of a starting circuit of the fluorescent lamp unit illustrated in FIG. 1, and FIGS. 5A and 5B are views for explaining wired portions of the fluorescent lamp unit illustrated in FIG. 1.

FIG. 4 shows the starting circuit of the fluorescent lamp unit according to this invention. As apparent from the circuit diagram, the starting circuit is such that in the ordinary starting circuit employing the inductive ballast, the ballast resistor 18 is substituted for the inductive ballast. Accordingly, the operation will be understood well. Here, the ballast resistor 18 does not generate the kick voltage when the glow switch 15 has turned "off", so that the capability of starting the circular fluorescent tube 1 lowers. The starter conductor 19 is therefore used as a starting aid. The potential of any desired part in the starting circuit shown in FIG. 4 is applied to the starter conductor 19. Alternatively, any wiring in the starting circuit may be used as the starter conductor 19. In this case, current flows through the starter conductor 19. Methods for starting fluorescent lamps with a ballast resistor and a starter conductor are described in detail in the specifications of U.S. Pat. Nos. 3,974,418 and 3,996,493.

The ballast resistor 18 used in the present embodiment has a structure as described hereunder. A nichrome lead which has a suitable wire diameter and length is wound on a heat-proof insulating substrate (for example, mica plate) so as to have a predetermined resistance value. Further, the substrate is sandwiched between two mica plates.

As the starter conductor 19, a striped conductor may well be formed by vacuum-evaporation instead of the coated lead described above.

Further, a reflective film (for example, one made of a metal such as Ni and Al) may be provided on the inner surface of the edge cover member 4 of the upper cover 2, thereby to reflect light from the circular fluorescent tube 1 downwards and to enhance the illuminance right under the tube. In this case, the reflective film can be used also as the starter conductor 19.

Figure 5A:
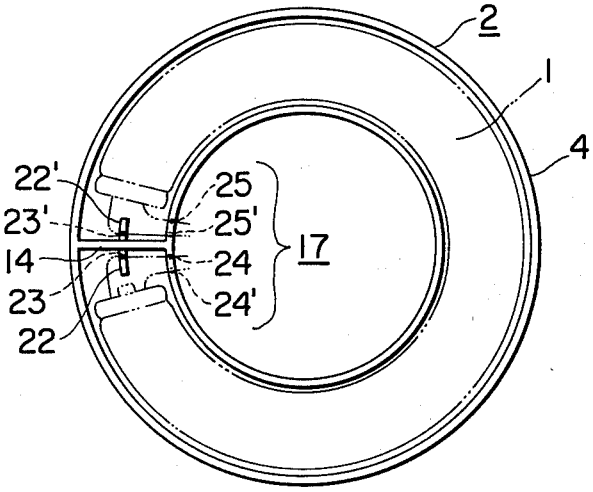
Figure 5B:
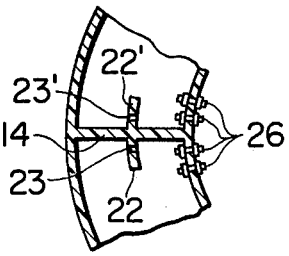

FIG. 5A shows a diagram with the edge cover member 4 of the upper cover 2 viewed from below in order to explain the disposal of the leads of the circular fluorescent tube 1. The separator 14 made of a resin similar to that of the upper cover 2 has partition walls 22 and 22' which protrude therefrom. The partition walls 22 and 22' have gaps 23 and 23' for holding the corresponding ends of the leads, respectively. Further, the inner wall of the edge cover member 4 has gaps 24, 24' and 25, 25' for separating the leads without shortcircuiting. When, in order to facilitate the electrical connections with the other circuit components, pressure-fit sleeves 26 as shown in FIG. 5B are buried in the gaps 24, 24' and 25, 25', the assemblage of the circuit is more simplified.

In the foregoing embodiments, it has been exemplified to use the ballast resistor as the stabilizer. Needless to say, however, if a stabilizer which is small in size, light in weight and low in price is developed, it can be used instead of the ballast resistor. It is also possible to use an incandescent lamp in place of the ballast resistor.

Although, in the foregoing, the means for connecting the upper cover and the lower cover are bolts and nuts, it is possible to use a structure wherein the opposing fore ends of the spacing columns are formed into male and female shapes so as to be snugly fitted under pressure.

As set forth above, the fluorescent lamp unit according to this invention can fix the circular fluorescent tube with the upper cover and the lower cover, can fix and support the ballast resistor with the spacing columns and does not require any other accessory component at all. Therefore, it has the features that the assemblage is very easy, that the circular fluorescent tube and the components necessary for the starting thereof are made integral, that the weight of the whole appliance is very light, and that the fluorescent lamp unit can be easily attached to and lit up with a socket.

It is understood that the present invention is not limited to the details shown and described herein but is susceptible to numerous changes and modifications as known to those skilled in the art such that the present invention is intended to cover all such changes and modifications as are encompassed by the scope of the appended claims.

We claim:

1. A fluorescent lamp unit comprising a circular fluorescent tube; an upper cover which overlies said circular fluorescent tube, which has, at one end, an edge cover member covering substantially an upper half surface of said circular fluorescent tube and which is provided with a screw base at the other end for insertion into threaded electrical sockets; a lower cover which underlies said circular fluorescent tube in a manner to oppose said upper cover and which comprises a protective cover member for covering a central portion of said upper cover surrounded by said fluorescent tube and holder members extending from said protective cover member to said edge cover member of said upper cover in order to partially support substantially a lower half surface of said circular fluorescent tube; and connection means for holding said upper cover and said lower cover in engagement.

2. A fluorescent lamp unit according to claim 1, wherein said connection means comprises first spacing columns which are disposed in said central portion of said upper cover, second spacing columns which are disposed in said protective cover member of said lower cover, and fixation means for interconnecting said first spacing columns and said second spacing columns.

3. A fluorescent lamp unit according to claim 2, further comprising a ballast resistor which is mounted between said first spacing columns and said second spacing columns.

4. A fluorescent lamp unit according to claim 1, wherein said connection means further comprises means for holding said edge cover member of said upper cover and said holder members of said lower cover in vertical engagement.

5. A fluorescent lamp unit according to claims 1 or 2, further comprising a starter conductor which is disposed on an inner surface of said edge cover member of said upper cover.

6. A fluorescent lamp unit according to claims 1 or 2, further comprising a reflective film which is disposed on an inner surface of said edge cover member of said upper cover.

7. A fluorescent lamp unit according to claim 3, wherein said fixation means extends through said spacing columns and ballast resistor.

8. A fluorescent lamp unit comprising:

(a) an upper cover provided with a fluorescent light tube receiving portion receiving and covering substantially an upper half of a circular fluorescent tube, said upper cover being provided with a screw base connector for electrically connecting said fixture to a threaded electrical socket;

(b) a lower cover having a protective cover member for covering a central portion of the upper cover and holder members extending from said protective cover member for supporting a lower half surface of said circular fluorescent tube;

(c) connection means for holding said upper and lower covers together with a fluorescent tube disposed therebetween; and (d) a fluorescent light tube starting circuit connected to said fluorescent light tube.

9. A fluorescent lamp unit according to claim 8, comprising separator means extending across said receiving portion for electrically shielding contact means of the starting circuit from respective ends of said fluorescent tube.

10. A fluorescent lamp unit according to claim 8, wherein said connection means comprises first spacing columns which are disposed in said central portion of said upper cover, second spacing columns which are disposed in said protective cover portion of said lower cover, and fixation means for interconnecting said first spacing columns and said second spacing columns.

11. A fluorescent lamp unit according to claim 10, wherein said connection means further comprises mutually engageable formations on said holder members and an out edge of said upper cover.

12. A fluorescent lamp unit according to claims 8 or 11, wherein said starting circuit includes a ballast resistor held between said central portion of the upper cover and the protective cover portion of the lower cover.

13. A fluorescent lamp unit according to claim 8, wherein upper and lower covers are formed of semi-transparent synthetic plastic.

14. A fluorescent lamp unit according to claim 8, wherein a reflective film is disposed on an inner surface of the fluorescent light tube-receiving portion of the upper cover.

15. A fluorescent lamp unit according to claims 1 or 8, wherein said holder members comprise at least a pair of strap-like members extending from said protective cover member of the lower cover around the lower half of said fluorescent tube to the peripheral edge of said upper cover.

* * * * *